US007374661B2

(12) United States Patent
Bridges et al.

(10) Patent No.: US 7,374,661 B2
(45) Date of Patent: May 20, 2008

(54) THERMAL CRACKING

(75) Inventors: Robert S. Bridges, Friendswood, TX (US); Sellamuthu G. Chellappan, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 428 days.

(21) Appl. No.: 11/247,033

(22) Filed: Oct. 11, 2005

(65) Prior Publication Data

US 2007/0080097 A1 Apr. 12, 2007

(51) Int. Cl.

| | |
|---|---|
| ***C10G 15/00*** | (2006.01) |
| ***C10G 45/00*** | (2006.01) |
| ***C07C 4/02*** | (2006.01) |

(52) U.S. Cl. ..... 208/106; 208/209; 585/648; 585/650

(58) Field of Classification Search ..... 208/106, 208/209; 585/648, 650
See application file for complete search history.

(56) References Cited

U.S. PATENT DOCUMENTS 3,176,047 A 3/1965 Braconier et al. ..... 260/683

FOREIGN PATENT DOCUMENTS

WO PCT/US2006/034156 12/2007

*Primary Examiner*—J. Parsa
(74) *Attorney, Agent, or Firm*—Roderick W. MacDonald

(57) ABSTRACT

A method for thermally cracking a hydrocarbonaceous feed material using a combustion fuel fired furnace wherein at least part of the combustion fuel employed in the furnace is syngas.

13 Claims, 1 Drawing Sheet

THERMAL CRACKING

BACKGROUND OF THE INVENTION

1. Field of the Invention

This invention relates to the thermal cracking (pyrolysis) of hydrocarbonaceous materials to form a plurality of individual chemical products. More particularly, this invention relates to the expansion of the product slate of individual chemicals produced by a conventional pyrolysis plant.

2. Description of the Prior Art

Thermal cracking of hydrocarbons is a petrochemical process that is widely used to produce olefins such as ethylene, propylene, butenes, butadiene, and aromatics such as benzene, toluene, and xylenes. In such an olefin production plant (cracking plant, pyrolysis plant, or plant), a hydrocarbonaceous feedstock such as ethane, naphtha, gas oil, or other fractions of whole crude oil is mixed with steam which serves as a diluent to keep the hydrocarbon molecules separated. This mixture, after preheating, is subjected to hydrocarbon thermal cracking at elevated temperatures (1,450 to 1,550 degrees Fahrenheit or F.) in a pyrolysis furnace (steam cracker or cracker).

The cracked product effluent of the pyrolysis furnace (furnace) contains hot, gaseous hydrocarbons of great variety (from 1 to 35 carbon atoms per molecule, or $C_1$ to $C_{35}$ inclusive, both saturated and unsaturated). This product contains aliphatics (alkanes and alkenes), alicyclics (cyclanes, cyclenes, and cyclodienes), aromatics, and molecular hydrogen (hydrogen).

This furnace product is then subjected to further processing to produce, as products of the plant, various, separate and individual chemical product streams such as hydrogen, ethylene, propylene, fuel oil, and pyrolysis gasoline. After the separation of these individual product streams from the process, the remaining cracked product contains essentially $C_4$ and $C_5$ hydrocarbons, and heavier gasoline components. This remainder is fed to a debutanizer wherein a crude $C_4$ stream is separated as overhead while the $C_5$ and heavier stream is removed as a bottoms product.

Such a $C_4$ stream can contain varying amounts of n-butane, isobutane, 1-butene, 2-butenes (both cis and trans isomers), isobutylene, acetylenes, and diolefins such as butadiene (both cis and trans isomers).

Thus, a cracking plant is composed of two basic sections. The first section is a thermal cracking unit that employs at least one furnace fired by at least one combustion fuel (fuel) to form the cracked gas furnace product. The second section is a separation unit that, by various fractionation processes, separates various individual product streams aforesaid from the cracked gas of the first section. These individual product streams are the final products of the plant, and are exported from the plant for marketing to third parties or used internally within the plant complex to make other products.

The thermal cracking section normally burns a mixture of combustible fuels in the heating of the cracking furnaces. Basic fuels for such furnaces are natural gas and recycled fuel gas that was produced in the plant itself.

Fuel gas is a by-product of the cracking process that is carried out in the thermal cracking section and is primarily (major amount or greater than half) a mixture of hydrogen and methane.

The individual product separation section, while making the desired individual product stream separations, routinely additionally separates at least one fuel gas stream that is suitable for combustion in a plant furnace.

Heretofore, a plant that employed natural gas as a substantial part of the fuel for its furnaces recycled essentially all of its fuel gas stream(s) to its or other plant furnaces so as to minimize the amount of natural gas that had to be purchased in order to fire the furnaces to the desired extent.

This recycled fuel gas was not processed, e.g., to make same acceptable to a common carrier pipeline, for purposes of marketing same to a third party as an individual plant product as was ethylene, propylene, and the like.

Synthesis gas (syngas) is made by way of several basic and well known processes, including the reforming process and the partial oxidation process, otherwise known as gasification. The steam reforming process reacts hydrocarbons with steam in the presence of a nickel catalyst to produce an equilibrium mixture of carbon monoxide and hydrogen. At the same time, the water gas shift reaction reacts carbon monoxide with water to produce carbon dioxide and hydrogen. The final product is thus a mixture of carbon monoxide, carbon dioxide, and hydrogen with trace amounts of methane. The hydrocarbon feed for the steam reforming process is usually natural gas, but can include hydrocarbon feeds as heavy as naphtha. For natural gas feedstocks, the hydrogen/carbon oxide ratio is typically 3.5 to 1.

The partial oxidation process reacts carbon with oxygen and steam, in a reducing atmosphere to produce a mixture of carbon monoxide, carbon dioxide, and hydrogen. Depending on the carbon source feed used in the reforming reaction and the specific processing scheme, the hydrogen/carbon oxide ($H_2/CO_x$) ratio in the syngas will vary widely depending on the ratio of oxygen-to-carbon and the ratio of water-to-carbon in the feed to the reactor. Other factors include the ratio of hydrogen-to-carbon in the carbonaceous feedstock as well as operating pressure and temperatures. Feedstocks can range from methane to petroleum coke or coal to naturally occurring hydrocarbonaceous materials or waste products. This partial oxidation process is also referred to as gasification, or more specifically, as coal gasification when coal is the feed.

Syngas is combustible. Currently syngas is combusted or otherwise burned only in Integrated Gasification Combined Cycle (IGCC) plants. Syngas cannot be substituted for natural gas, e.g., in conventional common carrier natural gas pipelines, because of its high hydrogen and carbon monoxide content and consequent low heating value on a volumetric basis, Btu/cubic foot of gas. Syngas is also employed to produce chemicals as explained later, but these processes do not in any way involve the combustion of syngas.

Although IGCC plants can employ as their primary feedstock a number of hydrocarbonaceous materials such as coal, oil, coke, refinery bottoms, biomass, and certain waste materials (municipal, hazardous, etc.), they find their roots in the evolution of coal gasification. The IGCC description will, for sake of clarity, hereafter be directed toward coal, but this is not to exclude the other feedstocks just mentioned.

Coal gasification to produce a commercial fuel is approaching 200 years of age in the United States, the first such application starting in 1816 in Baltimore to provide lighting in that city. By 1920 coal gas served an estimated 46 million people. Coal gas use declined in the 1930s and 1940s with the increasing availability of natural gas from Texas and Louisiana, but in the 1930s and 1940s Germany developed processes for producing gasoline, diesel, and other liquid fuels from coal. In this regard, the Fisher-Tropsch (F-T) process was developed and is still employed with syngas at present. F-T is a catalytic reaction that produces longer chain hydrocarbons (synfuels) from syngas.

Interest in the production of synfuels was stimulated by the energy crises of the 1970s which ultimately led to the IGCC process. This process involves an endothermic chemical conversion (partial oxidation) of a feed such as coal into syngas. The conversion is carried out in a gasifier that employs a maximum amount of carbon, a high temperature, a minimum amount of oxygen, and water. The raw syngas formed in the gasifier is then cleaned by removing particulates and chemical contaminates such as hydrogen sulfide, carbonyl sulfide, ammonia, and chlorides. The cleaned syngas is fed to a combustion turbine that drives an electric generator to produce electricity to feed into the power grid.

Hot exhaust gas from the combustion turbine generator plus process heat from the gasifier itself is passed to a waste heat recovery steam generator which drives a steam turbine/electric generator to produce additional electricity for the power grid. The combination of the combustion turbine generator and steam turbine generator together with intermediate heat recovery and steam generation is referred to as "combined cycle" and is the "CC" in IGCC.

Thus, IGCC technology is the integration of carbon gasification with combined cycle, and this combination significantly improves the efficiency for utilizing hydrocarbonaceous feeds as set forth hereinabove for electrical generation purposes with concomitant low pollutant formation.

IGCC technology is now proven and well established. It has been demonstrated with coal at a commercial scale for up to ten years at two sites in the United States and two in Europe. Although these IGCC plants were originally demonstration plants, they are now in regular commercial operation.

As already mentioned, cleaned syngas from an IGCC plant can be combusted in a gas turbine context. Alternatively, syngas can be employed in the production of chemicals such as hydrogen, carbon monoxide, fertilizer, methanol, ethanol, and other industrial chemicals; or in F-T processing to produce naphtha, diesel fuel, jet fuel, and wax; or to produce synthetic natural gas.

However, none of these alternative uses for syngas involve the combustion of the syngas, IGCC plants being the one and only technology at present that can employ syngas as a combustion fuel.

Syngas typically has an $H_2$/CO molar ratio of about 0.4/1 to about 0.7/1. It has a heating value of only about 260 to about 280 Btu per standard cubic foot (Btu/SCF) as compared to about 950 to about 1,100 Btu/SCF for natural gas. Syngas does not, therefore, come even close to the Btu value specification for common carrier natural gas pipelines. Accordingly, syngas is not a simple substitute as a combustion fuel, especially natural gas. For example, in a natural gas fired turbine, the fuel gas is only about two percent of the total gas flow and the remainder is air for dilution and combustion purposes. On the other hand, if syngas and the required diluent were to be substituted for natural gas in this application, it would account for fourteen to sixteen percent of the total gas flow, a very considerable increase in mass flow that turbine operators must seriously take into account. Another example is dry low $NO_x$ combustors. These combustors cannot use syngas as a combustion fuel because of its high hydrogen content which gives syngas a high flame speed that can initiate flashback and cause combustor failure. Syngas can also adversely affect the heat flux distribution between the radiant and convection sections of a furnace.

Accordingly, it would be desirable to find other uses for syngas as a combustion fuel. This invention does just that in the thermal cracking area, and does so with surprising additional results.

SUMMARY OF THE INVENTION

In accordance with this invention, syngas is employed as a combustion fuel for a pyrolysis furnace.

The application of this invention includes, but is not limited to, furnaces that heretofore operated with natural gas as at least a part of their combustion fuel.

Thus, this invention provides for the backing out of expensive combustion fuels from a cracking plant.

But this is not all. Pursuant to this invention, it has been surprisingly determined that with the employment of syngas as a combustion fuel in a cracking furnace, the amount of fuel gas formed in the furnace and separated in the individual product separation section of the plant downstream of the furnace allows fuel gas to be removed from the plant, and, with minimal additional processing, to be exported from the plant as a new net product of the plant. This is opposed to the prior art practice of recycling all the fuel gas within the plant or to other cracking plant furnaces.

Thus, this invention not only provides a new use for syngas as a cracking plant combustion fuel, but, in addition, adds a new individual product stream to the slate of individual finished chemical products heretofore produced by and exported from a cracking plant.

Accordingly, by this invention, the number of final products produced by a conventional cracking plant is surprisingly increased by way of a change in the furnace combustion fuel composition.

DETAILED DESCRIPTION OF THE INVENTION

Figure 1:
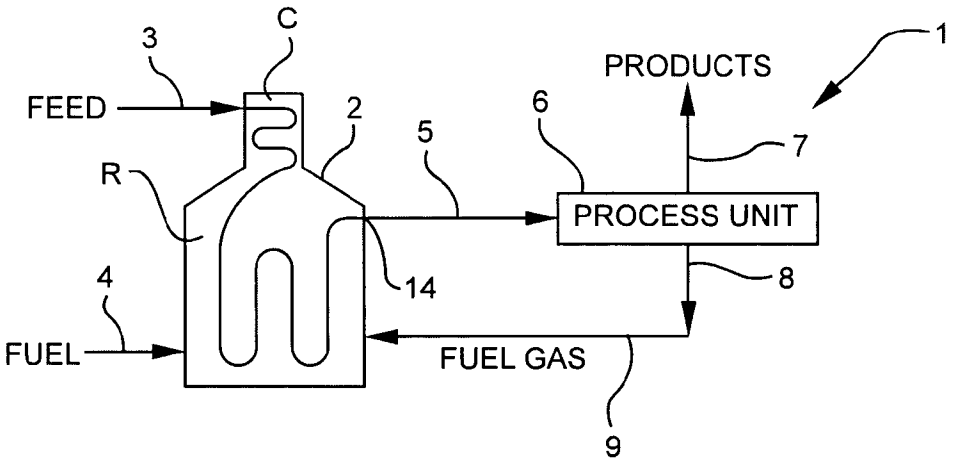
FIG. 1 Prior Art
FIG. 1 shows a flow diagram for a conventional cracking plant.

FIG. 1 shows a conventional cracking plant 1 whose first section is composed of at least one cracking furnace 2. Hydrocarbonaceous feed 3 is fed into convection heating section C of furnace 2 to be preheated, and then into radiant heating section R of furnace 2 to be thermally cracked. Combustion fuel 4 is supplied from outside plant 1 to furnace 2 as at least part of the primary heat source for these preheating and cracking functions. The cracked gas product of furnace 2 is passed by way of line 5 to the second section 6 of plant 1 for processing to separate from cracked gas 5 the various individual chemical streams, e.g., ethylene, propylene, and the like, that are the final products of plant 1, and that are exported from plant 1 as a finished product for sale or use elsewhere. For sake of simplicity, these various individual plant product streams are collectively shown as stream 7. Fuel gas formed in plant 1 is separated and collected in section 6, and returned in its entirety to furnace 2 by way of line 8. This plant fuel gas 8 is used in significant amounts for combustion, in combination with externally supplied fuel 4, in furnace 2 to complete the primary heat source for the above preheating and cracking functions.

Molecular hydrogen (hydrogen) and methane may or may not initially be present in feed 3, but each is formed during the cracking process in furnace 2, and significant amounts of each are present in cracked gas 5. While gas 5 is processed in second section 6 for separation of the individual plant products 7, various streams of hydrogen, methane, or a mixture of hydrogen and methane are also formed. Although high purity hydrogen may be separated as an individual finished product of the plant, many, if not all of these streams of hydrogen, methane and mixtures thereof are eventually collected in the fuel gas collection drum (not shown) of section 6. From this collection drum the thus formed plant fuel gas is recycled by way of lines 8 and 9 to one or more furnaces 2 for use as part of their combustion fuel to reduce the demand for externally supplied fuel 4.

Cracked gas processing section 6 employs a number of fractionation steps to cause the formation of the various individual products 7 and plant fuel gas 8. In a typical plant, quenching steps are first employed on gas 5 to separate liquid fuel oil and pyrolysis gasoline from gas 5, after which gas 5 is subjected to compression to separate five carbon atom ($C_5$) and heavier hydrocarbons. Thereafter, gas 5 is processed in a refrigeration unit and exposed to temperatures as low as minus 267 F to separate an individual high purity hydrogen stream, and, after hydrogen separation, to a thermal fractionation column known as a demethanizer to separate methane from the cracked gas. Following the demethanizer, the gas is passed to a number of separate thermal fractionation columns for the separation of other individual product streams such as a deethanizer followed by an ethane/ethylene splitter, a depropanizer followed by a propane/propylene splitter, and a debutanizer to form a $C_4$ stream. In this process a number of streams containing hydrogen, methane, or both are formed. Even when a pure hydrogen stream is exported from plant 1 as an individual product stream 7, other hydrogen streams that are less pure are separated and sent to the fuel gas drum along with other methane streams and streams containing both hydrogen and methane. Thus, the fuel gas drum is the source of plant fuel gas 8 of plant 1.

Plant fuel gas 8 is, therefore, primarily a widely varying mixture of hydrogen and methane, but generally it will contain from about 70 to about 95 mole percent (mol %) methane, and less than about 2 mol % ethane and/or ethylene, with the remainder being essentially hydrogen, all mol % based on the total moles of this mixture. This raw plant fuel gas 8, as opposed to the finished individual fuel gas product of this invention (element 13 of FIG. 2), has a heating value of less than 950 Btu/SCF, and is at a low pressure, e.g., from about 30 to about 60 psig. As such it is at a lower pressure than that required for export from plant 1, e.g., by way of a conventional common carrier pipeline. Its dew point and water content normally meets the specifications for a product that would be exportable from plant 1. It also normally is quite low in sulfur content, sulfur having earlier been removed during processing in section 6. Thus, it has been recognized by this invention that the upgrading of plant fuel gas 8 to a marketable product is technically feasible in an economical manner.

Figure 2:
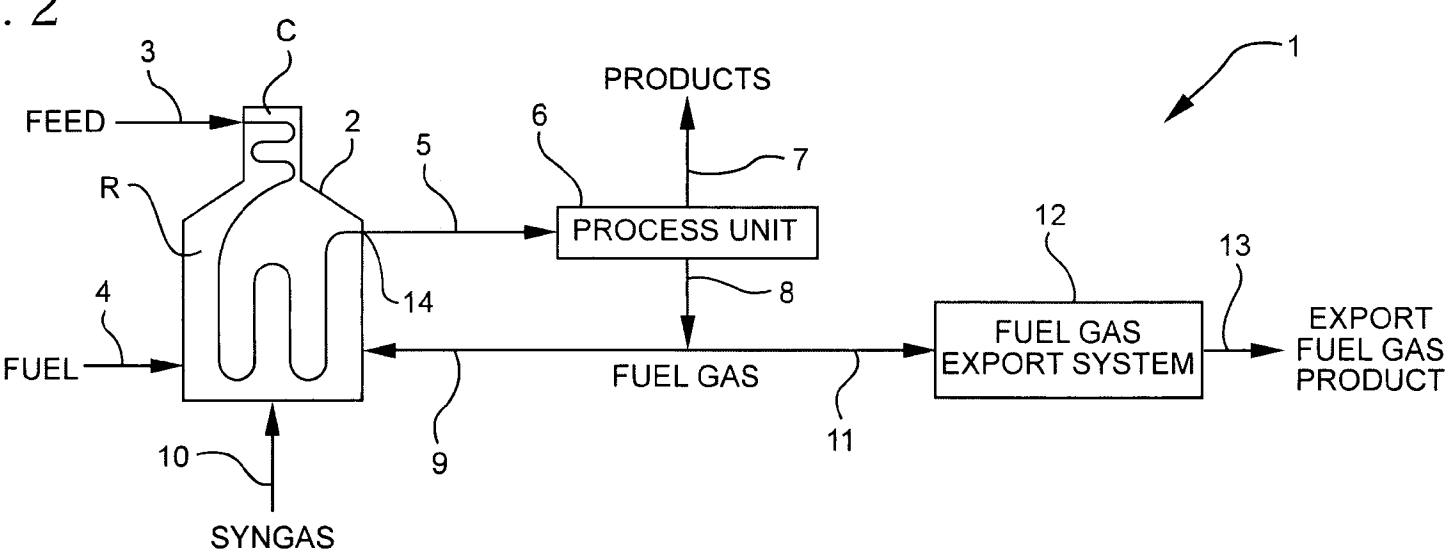
FIG. 2 shows a flow diagram for the plant of FIG. 1 employing one embodiment of this invention.

FIG. 2 shows plant 1 modified pursuant to this invention in that (A) syngas 10 is supplied to furnace 2 as a primary (significant) combustion fuel to supplement or otherwise replace all or part of furnace combustion fuels 4 and/or 9, and (B) at least part of plant fuel gas 8 is removed by way of line 11 to a fuel gas export processing system 12 to produce a finished fuel gas product 13 suitable for sale or other export from plant 1 as an additional individual product of that plant.

Syngas 10 is any product of the gasification process described hereinabove, and can contain from about 50 to about 65 mol % carbon monoxide, from about 25 to about 35 mol % hydrogen, from about 1 to about 15 mol % carbon dioxide, from about 1 to about 5 mol % nitrogen, and less than about 2 mol % methane, all mol % based on the total moles of syngas 10. Syngas 10, pursuant to this invention, can be adjusted as to its composition to better meet the combustion requirements of the burners in furnace 2. For example, a diluting gas such as steam, flue gas, nitrogen, or other inert gas can be added to alter the combustion characteristics, e.g., flame temperature, of both syngas 10 and the final fuel combination that is formed from the mixing of fuel 4 and syngas 10. It is this final fuel combination that is actually burned in furnace 2.

In FIG. 2 all or any part of plant fuel gas stream 8 can be passed to export unit 12 by way of line 11, the remainder, if any, being recycled by way of line 9 back to furnace 2 for mixing with fuel 4 and combustion in furnace 2. The fuel gas in line 9 can, if desired, be diluted with steam, flue gas, nitrogen or other inert gas to bring down the Btu value of gas 9 and open up its operating range in respect of the amount of this stream that can be burned in furnace 2.

Processing unit 12 takes raw plant fuel gas stream 11 and changes it into an individual finished fuel gas stream product 13 that is suitable for exporting for marketing and other use outside plant 1. This is in distinction to the complete combustion of raw plant fuel gas recycle stream 9.

In unit 12, stream 11 is processed to make it meet whatever specifications are required for the desired export disposition. For example, if stream 11 is to be exported by way of a common carrier pipeline, it is processed in unit 12 until it meets the specifications set forth by the particular operator that is to receive product 13, e.g., a pipeline operator. For this pipeline example, stream 11 will, in unit 12, be pressured up into the range required by the pipeline operator, e.g., at least about 400 psig, and often from about 400 to about 1,000 psig. In addition, the Btu content of stream 11 can be, but is not necessarily in all cases, altered by the removal of some of its hydrogen content and/or the addition of at least one Btu enhancing component such as ethane to make up for the low Btu content of the hydrogen that is to remain in stream 13. Generally, the Btu value specification for product stream 13 for pipeline purposes will be from about 900 to about 1,100 Btu/SCF. Normally stream 11 will not require any desulfurization processing in order to meet export requirements, pipeline or otherwise.

The processing of stream 11 so as to produce an individual plant product stream 13 suitable for export from plant 1 to a pipeline is a common form of processing for unit 12, but not the only form. Pursuant to this invention unit 12 can be employed to process stream 11 to meet any requirements for the export of stream 13. The particular type of processing carried on in unit 12 will, therefore, depend on the desired form of export, i.e., whether to a pipeline, fixed storage, railway transport, ship transport, or the like. Once the desired form of export is known, it is well within the skill of the art to determine the precise processing scheme to be employed in unit 12, and further detail in this regard is not necessary to inform the art.

Thus, individual final plant product 13 will have a composition that varies widely depending upon the form of export desired for that stream. Generally, the composition will contain at least about 80 mol % methane, and less than about 2 mol % ethane and/or ethylene, with the remainder being essentially hydrogen, all mol % based on the total moles of individual product 13.

Thus, in accordance with this invention and its use of syngas as a furnace fuel, sufficient additional fuel gas 11 is produced to allow for the processing of fuel gas by way of unit 12 to create an additional individual and separately marketable plant product 13. In this way conventional cracking plant 1 of FIG. 1 is expanded in its marketable product slate by the addition of product 13.

EXAMPLE

A cracking process is carried out as shown in FIG. 2 wherein feed 3 is composed of naphtha, and the total fuel firing rate for furnace 2 is 250 million Btu/hour.

A combination of externally supplied natural gas fuel 4, recycled plant fuel gas 9, and syngas 10 is used to fire the burners (not shown) in furnace 2 to about 1,450 F. Fuels 4, 9, and 10 are combined into a single fuel mixture before they are combusted in the burners of furnace 2. This combination of combustion fuels is composed of a mixture of about 6 mol % natural gas 4, about 6 mol % recycled plant fuel gas 9, and about 88 mol % syngas 10, all mol % based on the total moles of the mixture of fuels 4, 9, and 10. The 88 mol % of syngas fuel 10, when added to fuels 4 and 9, is sufficient to reduce by about 50 percent the mol % of natural gas fuel 4 required to fire furnace 2 to about 1,450 F. in the plant configuration of FIG. 1 where no syngas is employed as a combustion fuel. This amount of added syngas fuel 10, in addition, provides for the export, as product stream 13, of 80 mol % of the total fuel gas 8 formed in plant 1, the remaining 20 mol % being recycled to furnace 2 by way of line 9.

Natural gas fuel 4 has a composition of about 95 mol % methane, and about 2.5 mol % ethane, with the remainder being a mixture of propane, carbon dioxide, and nitrogen, all mol % based on the total moles of fuel 4.

Syngas fuel 10 has a composition of about 60 mol % carbon monoxide, about 30 mol % hydrogen, about 7 mol % carbon dioxide, about 2 mol % nitrogen, and about 1 mol % methane, all mol % based on the total moles of syngas stream 10.

Furnace 2 is operated so as to provide a temperature at radiant coil outlet 14 of about 1,450 F. thereby to cause thermal cracking of the naphtha feed in furnace radiant section R. Cracked gas 5 is removed from the furnace at about 1,450 F., and quenched to separate out liquid streams of fuel oil and pyrolysis gasoline. The remainder of the unquenched and still gaseous cracked gas is passed to process unit 6.

In unit 6 individual ethylene and propylene streams are removed from the cracked gas and exported from plant 1 to third party buyers. A $C_5$ and heavier compound stream and a separate stream containing $C_4$ compounds are both also separated from the cracked gas and exported from plant 1.

Various methane and hydrogen streams, alone and in mixture, are separated from cracked gas 5 and passed to the fuel gas drum of unit 6 for mixing therein to form plant fuel gas 8.

Plant fuel gas 8, and fuel gas streams 9 and 11, each have a composition of about 90 mol % methane, about 0.5 mol % ethane, about 0.5 mol % ethylene, and about 9 mol % hydrogen, all mol % based on the total moles of this fuel gas. Fuel gas streams 8, 9, and 11 each have a heating value of about 955 Btu/SCF, and each are at a pressure of about 50 psig.

Fuel gas 8 is removed from the fuel drum of unit 6, and about 20 mol % of the total is recycled by way of line 9 to the furnace for use as furnace combustion fuel, while the remaining 80 mol % is passed by way of line 11 to unit 12.

In unit 12 plant fuel gas 11 is compressed to a pipeline specification pressure of about 500 psig. Since the heating value for fuel gas 11 already meets pipeline requirements of 950 Btu/SCF, no additional methane or other Btu enhancements are needed in order to raise the heating value of stream 11 to meet pipeline specifications.

Fuel gas product stream 13 is composed of about 90 mol % methane, about 0.5 mol % ethane, about 0.5 mol % ethylene, and about 9 mol % hydrogen, all mol % based on the total moles of stream 13, and is exported as an additional, individual product from plant 1 to a third party buyer that operates a common carrier pipeline.

We claim:

1. In a process for the thermal cracking of at least one hydrocarbonaceous material wherein a combustion fuel fired furnace is employed, and wherein plant fuel gas is formed, said process producing at least one individual product for export from said process comprising the removal of at least part of hydrogen content and the addition of at least one BTU enhancing component, and comprising employing syngas as at least part of said combustion fuel.

2. The method of claim 1 wherein at least part of said plant fuel gas is recovered from said process and is further processed to produce an individual fuel gas product for export from said process in addition to said at least one individual product.

3. The method of claim 1 wherein said furnace is fired at least in part with at least one of natural gas and plant fuel gas, and said syngas is employed as a furnace combustion fuel in place of at least part of at least one of said natural gas and plant fuel gas.

4. The method of claim 1 wherein said syngas contains in major amount a mixture of hydrogen and carbon monoxide.

5. The method of claim 4 wherein said syngas contains from about 50 to about 65 mol % carbon monoxide, from about 25 to about 35 mol % hydrogen, from about 1 to about 15 mol % carbon dioxide, from about 1 to about 5 mol % nitrogen, and less than about 2 mol % methane, all mol % based on the total moles of said syngas.

6. The method of claim 1 wherein said plant fuel gas formed in said process contains methane in major amount and hydrogen in minor amount.

7. The method of claim 6 wherein said methane is present in an amount of from about 70 to about 95 mol %, said hydrogen is present in an amount of from about 3 to about 28 mol %, with the remainder being essentially a mixture of ethane and ethylene.

8. The method of claim 2 wherein said individual fuel gas product for export from said process contains at least about 80 mol % methane, and at least about 3 mol % hydrogen, with the remainder being essentially a mixture of ethane and ethylene.

9. The method of claim 2 wherein said plant fuel gas is processed to meet pipeline specifications for transport in said pipeline.

10. The method of claim 9 wherein said individual fuel gas product has a Btu content of at least about 950 Btu/SCF and is at a pressure of at least about 400 psig.

11. The method of claim 1 wherein said Btu enhancing component is methane.

12. The method of claim 1 wherein said further processing to produce said individual fuel gas product for export from said process excludes desulfurization of said fuel gas.

13. The method of claim 1 wherein said syngas is diluted with at least one gas to alter the flame temperature of said combustion fuel.

* * * * *